US008344299B1

(12) United States Patent
Lomax et al.

(10) Patent No.: US 8,344,299 B1
(45) Date of Patent: Jan. 1, 2013

(54) CYLINDER HEATER

(75) Inventors: Donald P. Lomax, Waukesha, WI (US); Starr L. Pitzer, Dallas, TX (US); Jack W. Rogers, Dallas, TX (US); George H. Blume, Austin, TX (US)

(73) Assignees: Novatech Holdings Corp., Salt Lake City, UT (US); Starr L. Pitzer, Dallas, TX (US)

( * ) Notice: Subject to any disclaimer, the term of this patent is extended or adjusted under 35 U.S.C. 154(b) by 456 days.

(21) Appl. No.: 12/622,774

(22) Filed: Nov. 20, 2009

(51) Int. Cl.
*H05B 6/36* (2006.01)
*H05B 6/14* (2006.01)
*H05B 6/12* (2006.01)

(52) U.S. Cl. ..... 219/674; 219/619; 219/676; 219/624

(58) Field of Classification Search ..... 219/674, 219/643, 629, 630, 607, 608, 611, 619, 622, 219/624, 627, 676, 774
See application file for complete search history.

(56) References Cited

U.S. PATENT DOCUMENTS

| | | | |
|---|---|---|---|
| 1,948,628 | A | 2/1934 | Penick et al. |
| 2,163,472 | A | 6/1939 | Shimer |
| 2,880,109 | A | 3/1959 | Current et al. |
| 2,918,078 | A | 12/1959 | Cummings |
| 3,186,430 | A | 6/1965 | Koutnik |
| 3,456,298 | A | 7/1969 | Foster et al. |
| 3,510,103 | A | 5/1970 | Carsello |
| 3,598,145 | A | 8/1971 | Wolfson |
| 3,809,362 | A | 5/1974 | Baumann |
| 3,836,341 | A | 9/1974 | Saltzman et al. |
| 4,089,466 | A | 5/1978 | Lomax et al. |
| 4,103,800 | A | 8/1978 | Lomax et al. |
| 4,373,550 | A | 2/1983 | Yelich |
| 4,399,198 | A | 8/1983 | Lomax et al. |
| 4,474,208 | A | 10/1984 | Looney |
| 4,490,411 | A | 12/1984 | Feder |
| 4,518,329 | A | 5/1985 | Weaver |
| 4,679,294 | A | 7/1987 | Lomax et al. |
| 4,696,321 | A | 9/1987 | Reese et al. |
| 4,714,237 | A | 12/1987 | Linderman et al. |
| 4,770,206 | A | 9/1988 | Sjoberg |
| 4,860,995 | A | 8/1989 | Rogers |
| 4,915,354 | A | 4/1990 | Sims, Jr. et al. |
| 5,023,145 | A | 6/1991 | Lomax et al. |
| 5,060,374 | A | 10/1991 | Findlanl et al. |
| 5,088,521 | A | 2/1992 | Johnson |
| 5,193,577 | A | 3/1993 | de Koning |
| 5,226,445 | A | 7/1993 | Surjaatmadja |
| 5,246,056 | A | 9/1993 | Lomax et al. |
| 5,247,960 | A | 9/1993 | Kornfeldt et al. |

(Continued)

*Primary Examiner* — Chuong A. Luu
(74) *Attorney, Agent, or Firm* — Gardere Wynne Sewell LLP

(57) ABSTRACT

A cylinder heater useful in fabricating sleeves for high pressure pump liners comprises a support rotatably supporting a hollow circular cylinder having a metallic powder layer contacting a portion of its inner surface. A vibration sensor indicates vibration of the cylinder, and at least one temperature sensor indicates at least one temperature of the cylinder. At least one circumferential induction heating coil around the cylinder is positionable via the support along the longitudinal axis of cylinder rotation. Longitudinal position and power output of at least one heating coil, and cylinder rotational speed, are adjusted by a controller communicating with the support, the vibration sensor, at least one temperature sensor, and at least one heating coil. Controlled heating of the cylinder and the metallic powder layer results in a stratified abrasion-resistant fused metallic layer on the cylinder's inner surface. The fused layer may be honed to make a liner sleeve.

20 Claims, 2 Drawing Sheets

U.S. PATENT DOCUMENTS 5,375,813 A 12/1994 Rozinsky
5,565,277 A 10/1996 Cox, Jr. et al.
5,827,050 A * 10/1998 Price ..... 417/207
6,298,817 B1 10/2001 Hoeg
6,701,955 B2 3/2004 McIntire et al.
6,959,916 B2 11/2005 Chigasaki et al.
6,969,831 B1 * 11/2005 Parker et al. ..... 219/528
7,053,344 B1 * 5/2006 Surjan et al. ..... 219/549
7,070,166 B1 7/2006 Blume
7,540,470 B1 6/2009 Blume
7,726,026 B1 6/2010 Blume
2002/0079332 A1 6/2002 McIntire et al.
2003/0132415 A1 7/2003 Chigasaki et al.

* cited by examiner

CYLINDER HEATER

FIELD OF THE INVENTION

The invention relates generally to high-pressure pumps that incorporate structural features and/or fabrication techniques providing improved liner wear resistance.

BACKGROUND

Engineers typically design high-pressure oil field pumps in two sections; the (proximal) power section (herein "power end") and the (distal) fluid section (herein "fluid end"). The power end usually comprises a crankshaft, reduction gears, bearings, connecting rods, crossheads, crosshead extension rods, etc. In mud pumps the power end also contains a liner comprising a hollow circular cylinder within which a piston is moved in a reciprocating manner by a piston rod. Notwithstanding their location reversibly secured in the power end frame, liners (and the pistons and piston rods within them) are considered part of a pump's fluid end. Commonly used mud pump fluid ends typically additionally comprise a suction valve and a discharge valve associated with each liner (with its piston and piston rod) in a sub-assembly, plus retainers and high-pressure seals, etc.

High-pressure pump liners were initially manufactured from cast iron, a traditional wear-resistant bearing material. These liners were subject to corrosion and experienced rapid cylinder wear at pressures greater than about 1,000 pounds per square inch (psi). Cast iron liners were eventually replaced about 1950 by induction-hardened steel liners that had greater strength and wear-resistance, but the hardened steel had lower corrosion resistance compared to cast iron. Chrome plating was then applied to the cylinder of a steel liner to improve both corrosion resistance and wear resistance, and operating pressures increased to the range of 2,000 to 3,000 psi. Unfortunately the relatively thin chrome plating tended to crack at higher pressures, leading to rapid degradation of the plating and failure of the cylinder. Attempts to harden the cylinder steel (as by carburizing) significantly raised manufacturing costs because warping induced during carburization required post-process grinding and honing of the cylinder that removed much of the carburized wear case. In the 1980's, attempts to improve the service life of Nitriloy steel liners by ion nitriding the cylinder wearing surface also proved unsuccessful. While it had a hard surface (70 Rockwell C), the nitrided portion of the cylinder steel was both susceptible to corrosion and relatively thin. Early failure of the nitrided cylinder portion exposed the softer steel comprising the remainer of a liner to rapid wear and, occasionally, catastrophic failure.

Such catastrophic failures are almost unknown today, thanks to the wide use of industry standard liners comprising two parts: a chrome iron sleeve shrunk-fit within an outer steel hull. While providing better performance than the liners described above, these chrome-iron liner sleeves are expensive and labor intensive to manufacture largely because the mating surfaces of the sleeve and hull must be machined or ground to close tolerances prior to shrink fitting of the sleeve within the hull.

Chrome-iron liner sleeves offer several advantages over other types of liner sleeves and over liners without sleeves. First, a relatively high level of free chrome in the sleeve assures good corrosion resistance and longer life. Second, relatively high carbon and chrome levels in the sleeve allow the formation of very wear-resistant chrome carbides. And since the sleeve has the same uniform hardness throughout its cross section, wear resistance does not decrease as the sleeve wears. Thus, catastrophic wear-through failures are almost entirely avoided, although a sleeve may become loosened and slide longitudinally within its hull due to insufficient hull hoop stress following shrink fitting of the hull over the sleeve.

Uniformity of wear resistance throughout liner service life, as seen in chrome-iron liner sleeves, is also seen in ceramic and zirconium liner sleeves. Both ceramic and zirconium sleeves offer excellent corrosion resistance and a 300-400% increase in wear life over hardened steel liners without such sleeves. However, ceramic and zirconium sleeves are very expensive and very brittle, requiring delicate handling on a drilling rig where the work environment is far from delicate. Additionally ceramic and zirconium sleeves have the disadvantage of being heat insulators. That is, they tend to store the substantial frictional heat that develops primarily due to movement of the piston's elastomeric seal material on the sleeve's cylindrical inner wall. While metallic sleeves tend to conduct at least a portion of this frictional heat away from the piston-sleeve interface, ceramic and zirconium sleeves tend to store the heat instead. Stored heat results in increased piston operating temperatures that degrade piston seals, eventually allowing a piston flange to contact the sleeve wall and damage it. Thus, chrome-iron liner sleeves remain the most popular choice for oil field operations.

The chrome-iron used in industry standard liner sleeves typically comprises 25-28% chrome, 2.5% carbon, some trace elements, with the balance being iron. In some industries this alloy is referred to as "white iron." The alloy has excellent wear and corrosion resistance, but chrome-iron sleeve liners are expensive and labor-intensive to manufacture. The chrome-iron sleeve must be centrifugally cast, and because of the centrifugal force generated during casting, the favorable, heavier, alloy particles are primarily distributed closer to the outside diameter (OD) of the sleeve casting. Slag and other undesirable particles, on the other hand, are distributed on the internal diameter (ID) of the sleeve casting. Because the wear surface is on the ID, this particle arrangement after casting is just the opposite of the desired distribution. Thus the casting is made overly thick so the undesirable materials can be removed by machining that increases the ID.

But when the sleeve casting is removed from the centrifugal mold, the casting is at full hardness, approximately 60 Rockwell C, and can not be machined. Rather, the casting must first be annealed to a machinable state, which usually takes 24 hours in an annealing furnace. The casting is then rough machined, with about one half the wall thickness being machined away to remove the undesirable particles from the casting ID. The casting is also cut into lengths at this time to make sleeves for the many different liner designs. Sleeves are then heat treated to regain the hardness of 60 Rockwell C, but since the sleeves warp during heat treatment, they must be returned to a near-round condition.

Because of the hardness of the heat-treated (and out-of-round) sleeves, they cannot be machined. Instead, they must be ground on their OD. After grinding, the sleeve OD is measured and a steel hull is bored to an ID dimension slightly smaller than the OD of the ground sleeve. The hull is then heated to approximately 500-700° F.; at which temperature the hull ID increases so that it exceeds the OD of the ground sleeves. The ground sleeve is slipped into the ID of the hull, and as the sleeve-hull (i.e., the liner) assembly cools the hull shrinks around the sleeve to lock it in place and place the sleeve in compression via the hoop tension developed in the hull as it shrinks. After cooling, the sleeve ID is honed to bring its ID to one of several standard sizes within American Petroleum Institute (API) size tolerances. The hull OD is then machined to the final design dimensions for liners used in a particular pump.

Liners comprising a hull shrunk-fit over a chrome-iron sleeve made according to the above process are much more durable than the original cast iron liners, but are also relatively more expensive and difficult to make, with substantial requirements for manual operations. An improved liner is needed that will substantially equal or outperform the current industry standard liner while reducing manufacturing cost.

SUMMARY OF THE INVENTION

A cylinder heater useful in fabricating sleeves for high pressure pump liners comprises a support rotatably supporting a hollow circular cylinder having a metallic powder layer contacting a portion of its inner surface. A vibration sensor indicates vibration of the cylinder, and at least one temperature sensor indicates at least one temperature of the cylinder. At least one circumferential induction heating coil around the cylinder is positionable via the support along the longitudinal axis of cylinder rotation. Longitudinal position and power output of at least one heating coil are adjusted by a controller communicating with the support, the vibration sensor, at least one temperature sensor, and at least one heating coil. Each heating coil heats at least a portion of the cylinder and the metallic powder layer within, resulting in a fused stratified metallic layer (termed herein a fusion layer) fused with a portion of the cylinder's inner surface. The metallic powder layer and the fusion layer each comprise at least one abrasion-resistant material (e.g., tungsten carbide) and at least one cement (e.g., nickel), each abrasion-resistant material having greater density than each cement. The fusion layer may be subsequently honed to provide a long-wearing sleeve for a high-pressure pump liner.

The invention comprises methods and apparatus that, in certain respects, reflect steps backward in time, using materials previously overlooked, rejected or superceded. Such materials are modified and manipulated in new ways to make liners for high pressure pumps that offer long-sought advantages over current industry standard practices. For example, various liner embodiments of the invention comprise a hollow ductile (i.e., nodular) iron hull closely fitting around a circular cylindrical sleeve, the sleeve itself having a fusion layer as described above. Predetermined radial compressive forces of the hull on the sleeve and its inner metallic layer develop and persist during controlled cooling of the hull after application of heat for shrink fitting. The cooled hull may comprise ferrite and martensite in a plurality of predetermined concentration ratios which, in addition to compressive force, provide stress relief and vibration damping which extend liner service life.

Liner fabrication methods related to the invention provide unprecedented control of both hull and sleeve composition and properties, allowing adjustment of liner design parameters in light of operational requirements specific to various pumps. Reuse of portions of fabrication tooling increases production efficiency, while elimination of certain material removal operations minimizes both costs and uncertainties due to tolerance buildup. Use of relatively low-melting-point materials (e.g., various compositions of cast ferrous alloys and/or metallic powders) reduces energy requirements compared to those associated with manufacture of conventional hulls.

The cylinder heater embodiment illustrated in FIGS. 1 and 2, as well as other embodiments described herein, are useful during sleeve fabrication. The illustrated embodiment comprises a hollow circular cylinder symmetrical about a longitudinal axis and having a first end, a second end, a cylinder length between the first and second ends, a first inner surface having a first inner diameter adjacent the first end, a second inner surface having a second inner diameter adjacent the second end, and a third inner surface having a third inner diameter between the first inner surface and the second inner surface.

The illustrated cylinder heater embodiment further comprises a support for rotating the hollow circular cylinder about its longitudinal axis at a plurality of predetermined rotational speeds, as well as a metallic powder layer contacting the third inner surface. A vibration sensor coupled to the hollow circular cylinder indicates a vibration level of the hollow circular cylinder, and the vibration level reflects evenness of distribution of the metallic powder layer on the third inner surface during rotation of the hollow circular cylinder about its longitudinal axis. At least one temperature sensor indicates at least one temperature of the hollow circular cylinder.

Additionally, the illustrated cylinder heater embodiment comprises one circumferential induction heating coil around the hollow circular cylinder for heating the hollow circular cylinder and the metallic powder layer. The circumferential induction heating coil is movably coupled to the support and has a coil length along the longitudinal axis. Thus, the circumferential induction heating coil is longitudinally positionable over a plurality of predetermined portions of the hollow circular cylinder. Still further, the illustrated cylinder heater embodiment comprises a controller communicating with the vibration sensor, at least one temperature sensor, the support, and at least one circumferential induction heating coil, the controller controlling longitudinal positioning and power output from at least one circumferential induction heating coil, and the controller controlling rotational speed of the hollow circular cylinder about its longitudinal axis.

In the illustrated embodiment, the third inner diameter exceeds the first inner diameter and the second inner diameter. And while the embodiment schematically illustrated herein shows a single circumferential induction heating coil wherein the cylinder length exceeds the coil length, other embodiments of a cylinder heater (not shown herein) may comprise at least one circumferential induction heating coil, each such heating coil having a coil length which may be greater than, equal to, or less than the cylinder length. Such other embodiments of a cylinder heater may comprise a controller communicating with the vibration sensor, at least one temperature sensor, the support, and at least one circumferential induction heating coil, the controller controlling longitudinal positioning and power output from at least one circumferential induction heating coil, and the controller controlling rotational speed of the hollow circular cylinder.

Note that while the illustrated embodiment schematically illustrates electronic communication between the controller and the sensors for vibration and temperature, such communication may be facilitated (in whole or in part) by one or more human operators. Indeed, the sensing process itself (for temperature and/or vibration) may be analogously facilitated by one or more human operators in a manufacturing environment.

A sleeve fabricated using a cylinder heater as described herein, and having the structural features disclosed herein, may be shrunk fit within a hull to form an improved liner embodiment for a high pressure pump. Such an improved liner may comprise a hollow ductile iron hull having an outer surface comprising a mounting flange and a substantially circular cylindrical inner surface, as well as a first end and a second end separated by an axial length. The concentric hollow circular cylindrical sleeve is located within the hull and closely contacts the hull inner surface. The hull supports the sleeve and exerts circumferential compression thereon as a function of hoop tension in the hull. In at least one improved liner embodiment, a first circumferential portion of the hull near the hull outer surface has a first predetermined ratio of martensite concentration to ferrite concentration, while a second circumferential portion of the hull near the hull inner surface has a second predetermined ratio of martensite concentration to ferrite concentration. Further, ratios of martensite concentration to ferrite concentration within transverse sections of the hull may vary in a substantially predetermined manner along the hull's axial length.

An improved liner embodiment may comprise, for example, an AISI 8620 steel sleeve with a fused metallic inner layer (fusion layer) substantially comprising tungsten carbide and nickel. The sleeve may comprise a circumferential flange at one end for securing the sleeve against longitudinal slippage within a hull under internal pump pressure. Hoop tension may vary, or may be substantially constant, along a hull's axial length. And a hull may comprise particular constituents and/or particular concentrations (e.g., about 2.5% to about 4.5% carbon, about 0.04% to about 0.5% retained magnesium, or retained cerium), the latter two materials for facilitating nodularization of carbon.

DETAILED DESCRIPTION OF THE ILLUSTRATED EMBODIMENT

Figure 1:
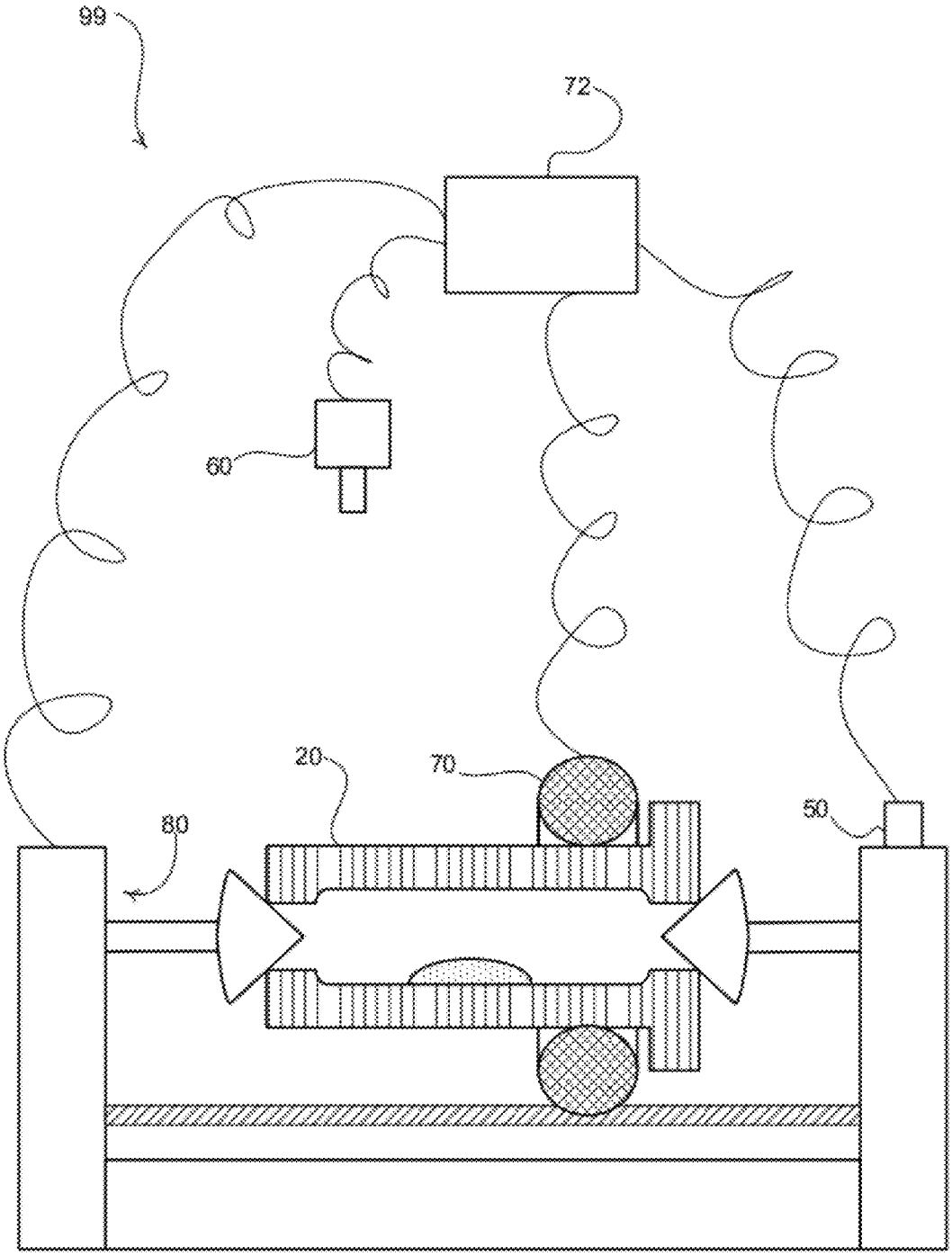
FIG. 1 is a cross-sectional schematic view of one embodiment of a cylinder heater showing a cylinder, a support, a metallic powder layer within the cylinder, a circumferential induction heating coil, a temperature sensor, a vibration sensor and a controller, the controller communicating with the support, the heating coil, the vibration sensor and the temperature sensor.
Figure 2:
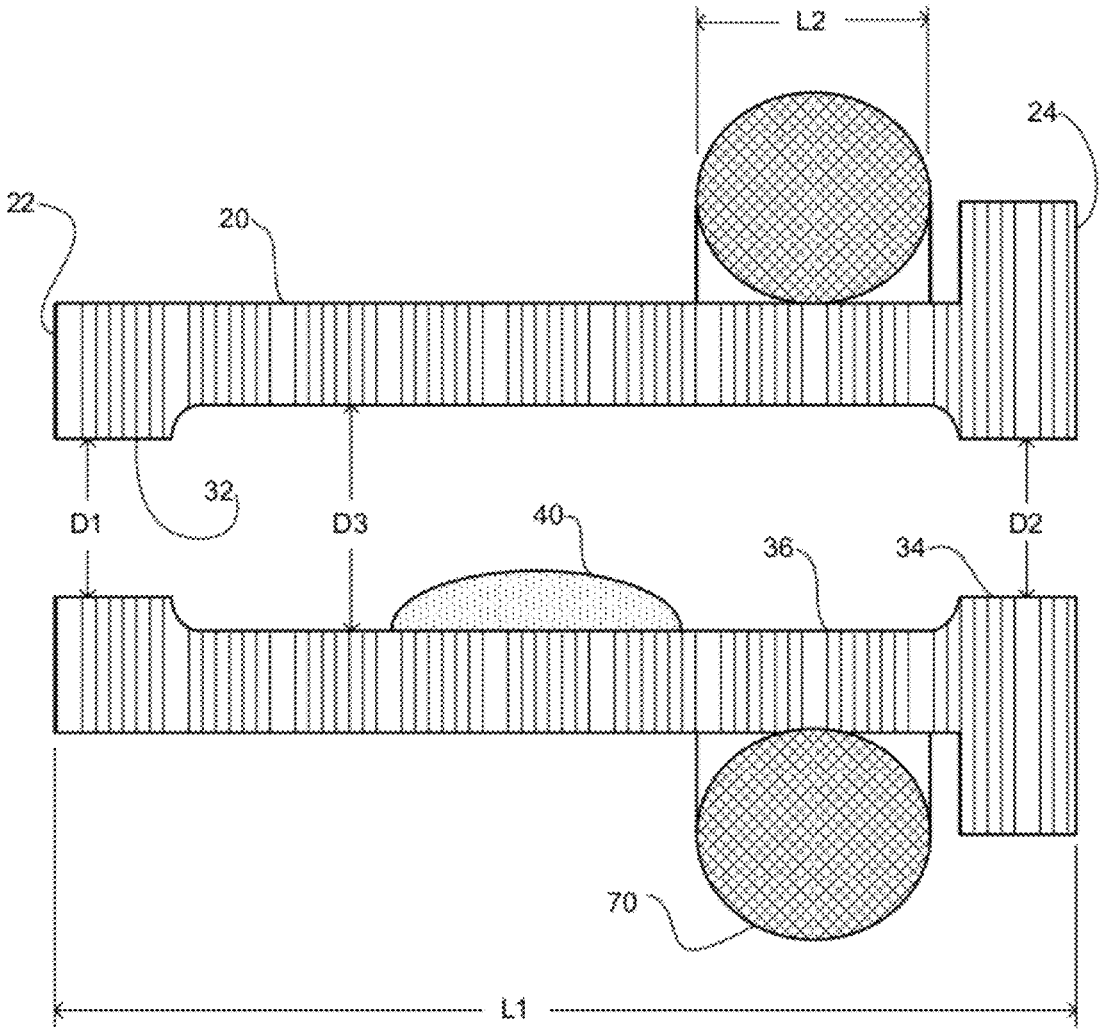
FIG. 2 is an enlarged cross-sectional schematic view of the cylinder and metallic powder layer of FIG. 1.

FIG. 1 schematically illustrates an embodiment of a cylinder heater 99 which comprises a hollow circular cylinder 20 symmetrical about a longitudinal axis. Details of cylinder 20 (seen labeled in FIG. 2) include a first end 22, a second end 24, a cylinder length L1 between the first and second ends, a first inner surface 32 having a first inner diameter D1 adjacent first end 22, a second inner surface 34 having a second inner diameter D2 adjacent second end 24, and a third inner surface 36 having a third inner diameter D3 between first inner surface 32 and second inner surface 34.

The illustrated cylinder heater embodiment of FIG. 1 further comprises a support 80 for rotating hollow circular cylinder 20 about its longitudinal axis at a plurality of predetermined rotational speeds, as well as a metallic powder layer 40 contacting third inner surface 36. A vibration sensor 50 is coupled to hollow circular cylinder 20 via support 80; vibration sensor 50 may thus indicate evenness of distribution of metallic powder layer 40 on third inner surface 36 during rotation of hollow circular cylinder 20 about its longitudinal axis. At least one temperature sensor 60 indicates at least one temperature of hollow circular cylinder 20. A controller 72 receives inputs from vibration sensor 50 (a vibration level of the support reflecting at least in part vibration of cylinder 20), temperature sensor 60 (at least one temperature of cylinder 20), and support 80 (rotational speed of cylinder 20 about its longitudinal axis, and at least one coil longitudinal position), while supplying outputs to support 80 (for controlling rotational speed and/or longitudinal coil positioning) and circumferential induction heating coil 70 (for controlling heating power output from the coil). Each controller output is a function of at least one controller input.

Circumferential induction heating coil 70 around hollow circular cylinder 20 functions for heating hollow circular cylinder 20 and metallic powder layer 40. Circumferential induction heating coil 70 is movably coupled to support 80 and has a coil length L2 along the longitudinal axis. Thus, circumferential induction heating coil 70 is longitudinally positionable by controller 72 via support 80 over a plurality of predetermined portions of hollow circular cylinder 20. Thus, controller 72 controls predetermined rotational speeds of cylinder 20 using inputs from vibration sensor 50, as well as longitudinally positioning, and adjusting power output from, each circumferential induction heating coil 70 as, for example, functions of at least one temperature of hollow circular cylinder 20.

In the illustrated embodiment of FIG. 1, third inner diameter D3 exceeds first inner diameter D1 and second inner diameter D2, and at least one function of at least one hollow circular cylinder temperature is nonlinear. And while the above illustrated embodiment schematically illustrates a single circumferential induction heating coil wherein the cylinder length L1 exceeds the coil length L2, other embodiments of a cylinder heater (not shown) may comprise at least one circumferential induction heating coil, each such heating coil having a coil length which may be greater than, equal to, or less than the cylinder length. Such other embodiments of a cylinder heater may comprise a controller communicating with the vibration sensor, at least one temperature sensor, the support, and at least one circumferential induction heating coil, the controller controlling longitudinal positioning and power output from at least one said circumferential induction heating coil, and the controller controlling rotational speed of the hollow circular cylinder.

Note that support 80 is schematically shown as a lathe for clarity of explanation. Cylinder 20 is supported between the lathe headstock and tailstock (schematically illustrated by the conical structures adjacent first end 22 and second end 24 of cylinder 20 in FIG. 1). Cylinder 20 is rotated via the headstock about its longitudinal axis at predetermined rotational speeds set by controller 72. Circumferential induction heating coil 70 is schematically shown movably coupled to support 80 via a lathe feedscrew so that its longitudinal position may also be set by controller 72 via support 80. Any alternative support that provides the functions of the claims in an analogous manner to that described may be used instead of a lathe.

Note also that although tungsten carbide and nickel are identified as possible components of metallic powder layer 40, additional/different components of metallic powder layer 40 may be found in various embodiments. For example, diamond power may be combined with one or more carbides to increase abrasion resistance. Since in most such combinations the abrasion-resistant components do not bond well with the material of cylinder 20 (typically alloy steel), the abrasion-resistant component(s) of the metallic powder layer are then typically held in place in a fusion layer by one or more cements which themselves form an adequate bond with the substrate material of cylinder 20. The stratification present in a fusion layer results from centrifugal force which tends to move the relatively more dense abrasion-resistant component(s) radially outward from the relatively less dense cement(s). Thus, that portion of a fusion layer adjacent to an inner surface of cylinder 20 tends to be relatively rich in abrasion-resistant component(s), while that portion of the fusion layer more distant from the inner surface of cylinder 20 tends to be relatively rich in cement(s).

To facilitate mixing one or more abrasion-resistant material(s) with one or more cement(s), the abrasion-resistant material(s) are provided in powder form. Such powders (e.g., carbides of vanadium, molybdenum, tungsten and/or chromium, with or without powdered diamond) are combined with one or more cements (comprising, e.g., cobalt, chromium, and/or nickel) and placed within cylinder 20. Rotation of cylinder 20 at predetermined rotational speeds simultaneously mixes the powders and distributes the mixed powders in a layer over third inner surface 36. Evenness of the powder layer distribution may be inferred from vibration of cylinder 20 as it rotates about its longitudinal axis. When the powder layer distribution is sufficiently even over third inner surface 36, sufficient heat is applied via circumferential induction heating coil 70 to fuse material(s) of the former powder layer to (rotating) inner surface 36, thus forming a fusion layer. Such fusion is associated with stratification as noted above and described further below.

Prior to formation of a fusion layer, centrifugal force associated with rotation of cylinder 20 about its longitudinal axis at a first (relatively low) rotational speed tends to redistribute and mix the metallic powder over inner surface 36. Then, during the subsequent heating that accompanies formation of the fusion layer, while cylinder 20 is rotating about its longitudinal axis at a second (relatively higher) rotational speed, centrifugal force tends to act on the fusing powder to redistribute the (relatively more dense) abrasion-resistant material (s) peripherally, relative to any (relatively less dense) cements that present. The fusion layer thereby becomes stratified, and when it is subsequently honed the less-dense material(s) will be removed, leaving a highly abrasion-resistant inner surface fused to an inner surface of cylinder 20.

Conversion of the initial metallic powder layer to a stratified fusion layer requires precise control of process variables such as power levels, spot temperatures, temperature gradients, rotational speeds, and longitudinal movement of circumferential induction heating coil 70. Control points are not generally predictable, but must be determined in real time and implemented using controller 72. Precise control is required, for example, to prevent excessive migration of iron from cylinder 20 into the fusion layer while the fusion layer is forming. Excessive iron migration would tend to reduce the abrasion resistance of the final honed fusion layer.

Abrasion resistance of the honed fusion layer arises from abrasion-resistant particles (e.g., metallic carbide particles) bound to the (typically alloy steel) substrate of cylinder 20 via one or more cements. An example of the need for real-time control using an embodiment of the claimed cylinder heater arises when cemented carbides comprise a matrix consisting of a dispersion of very hard carbide particles in a (relatively softer) cement. The resulting cemented carbide layers are not homogeneous, even on a honed surface, so they do not possess uniform abrasion resistance across the surface. One problem associated with this inhomogeneity becomes evident because of the grinding action of slurry particles caught between piston sealing surfaces and the fusion layer of a mud pump sleeve. A variety of slurry particle sizes is typically present, some so fine that they are smaller than the spacing between the carbide particles in the cemented carbide fusion layer. These fine slurry particles are very abrasive, and if they can fit between the carbide particles they can rapidly wear away the relatively soft cement holding the carbide particles in place. Thus loosened (but not actually worn down), the carbide particles can simply be carried away by the slurry stream, leaving the remainder of the cement exposed to further damage by the abrasive slurry. Problems associated with inhomogeniety of cemented carbide fusion layers may be reduced by controlling process variables in real time to obtain a relatively high carbide content overall (e.g., about 85% to about 95%), with a concentration of sub-micron carbide particle sizes at and near the surface of the honed fusion layer. Note that the stratified fusion layer (obtainable with use of a cylinder heater as described herein) will tend to have such desirable characteristics.

What is claimed is:

1. A cylinder heater comprising a hollow circular cylinder symmetrical about a longitudinal axis and having a first end, a second end, a cylinder length between said first and second ends, a first inner surface having a first inner diameter adjacent said first end, a second inner surface having a second inner diameter adjacent said second end, and a third inner surface having a third inner diameter between said first inner surface and said second inner surface;

a support for rotating said hollow circular cylinder about said longitudinal axis at a plurality of predetermined rotational speeds;

a metallic powder layer contacting said third inner surface;

a vibration sensor coupled to said hollow circular cylinder for indicating a vibration level of said hollow circular cylinder;

at least one temperature sensor for indicating at least one temperature of said hollow circular cylinder;

at least one circumferential induction heating coil around said hollow circular cylinder for heating said hollow circular cylinder and said metallic powder layer, each said circumferential induction heating coil being movably coupled to said support and having a coil length along said longitudinal axis, and each said circumferential induction heating coil being longitudinally positionable over a plurality of predetermined portions of said hollow circular cylinder;

a controller communicating with said vibration sensor, at least one said temperature sensor, said support, and at least one said circumferential induction heating coil, said controller controlling longitudinal positioning and power output from at least one said circumferential induction heating coil, and said controller controlling rotational speed of said hollow circular cylinder;

wherein said third inner diameter exceeds said first inner diameter and said second inner diameter; and wherein said metallic powder layer comprises at least one abrasion-resistant material and at least one cement, each said abrasion-resistant material having greater density than each said cement.

2. The cylinder heater of claim 1 wherein said first inner diameter equals said second inner diameter.

3. The cylinder heater of claim 2 wherein said third inner diameter exceeds said first inner diameter by about 0.1 inches.

4. The cylinder heater of claim 1 wherein said hollow circular cylinder has a nonuniform metallic composition radially.

5. The cylinder heater of claim 1 wherein said predetermined rotational speeds are between about 600 rpm and about 1000 rpm.

6. The cylinder heater of claim 1 wherein each said coil length is between about 20% and about 40% of said cylinder length.

7. The cylinder heater of claim 1 wherein said metallic powder layer comprises tungsten carbide.

8. A cylinder heater comprising a hollow circular cylinder symmetrical about a longitudinal axis and having a first end, a second end, a cylinder length between said first and second ends, a first inner surface having a first inner diameter adjacent said first end, a second inner surface having a second inner diameter adjacent said second end, and a third inner surface having a third inner diameter between said first inner surface and said second inner surface;

a support for rotating said hollow circular cylinder about said longitudinal axis at a plurality of predetermined rotational speeds;

a metallic powder layer substantially symmetrical about said longitudinal axis and contacting said third inner surface;

a vibration sensor coupled to said hollow circular cylinder for indicating a vibration level of said hollow circular cylinder;

at least one temperature sensor for indicating at least one temperature of said hollow circular cylinder;

at least one circumferential induction heating coil around said hollow circular cylinder for heating said hollow circular cylinder and said metallic powder layer, each said circumferential induction heating coil being movably coupled to said support and having a coil length along said longitudinal axis, and each said circumferential induction heating coil being longitudinally positionable over a plurality of predetermined portions of said hollow circular cylinder;

a controller communicating with said vibration sensor, at least one said temperature sensor, said support, and at least one said circumferential induction heating coil, said controller controlling longitudinal positioning and power output from at least one said circumferential induction heating coil, and said controller controlling rotational speed of said hollow circular cylinder;

wherein said third inner diameter exceeds said first inner diameter and said second inner diameter; and wherein said metallic powder layer comprises at least one abrasion-resistant material and at least one cement, each said abrasion-resistant material having greater density than each said cement.

9. The cylinder heater of claim 8 wherein said first inner diameter equals said second inner diameter.

10. The cylinder heater of claim 9 wherein said third inner diameter exceeds said first inner diameter by about 0.1 inches.

11. The cylinder heater of claim 8 wherein said coaxial inner sleeve comprises 8620 steel.

12. The cylinder heater of claim 8 wherein said predetermined rotational speeds are between about 600 rpm and about 1000 rpm.

13. The cylinder heater of claim 8 wherein each said coil length is between about 20% and about 40% of said cylinder length.

14. The cylinder heater of claim 8 wherein said metallic powder layer comprises tungsten carbide.

15. A cylinder heater comprising a hollow circular cylinder symmetrical about a longitudinal axis and having a first end, a second end, a cylinder length between said first and second ends, a first inner surface having a first inner diameter adjacent said first end, a second inner surface having a second inner diameter adjacent said second end, and a third inner surface having a third inner diameter between said first inner surface and said second inner surface;

a support for rotating said hollow circular cylinder about said longitudinal axis at a plurality of predetermined rotational speeds;

a metallic powder layer substantially symmetrical about said longitudinal axis and contacting said third inner surface;

a vibration sensor coupled to said hollow circular cylinder for indicating a vibration level of said hollow circular cylinder;

at least one temperature sensor for indicating at least one temperature of said hollow circular cylinder;

a first circumferential induction heating coil and a second circumferential induction heating coil around said hollow circular cylinder for heating said hollow circular cylinder and said metallic powder layer, each said circumferential induction heating coil being movably coupled to said support, and said first and second circumferential induction heating coils having first and second coil lengths respectively along said longitudinal axis, each said circumferential induction heating coil being longitudinally positionable over a plurality of predetermined portions of said hollow circular cylinder;

a controller communicating with said vibration sensor, at least one said temperature sensor, said support, and at least one said circumferential induction heating coil, said controller controlling longitudinal positioning and power output from at least one said circumferential induction heating coil, and said controller controlling rotational speed of said hollow circular cylinder;

wherein said third inner diameter exceeds said first inner diameter and said second inner diameter;

wherein said metallic powder layer comprises at least one abrasion-resistant material and at least one cement, each said abrasion-resistant material having greater density than each said cement.

16. The cylinder heater of claim 15 wherein said first inner diameter equals said second inner diameter.

17. The cylinder heater of claim 16 wherein said third inner diameter exceeds said first inner diameter by about 0.1 inches.

18. The cylinder heater of claim 15 wherein said coaxial inner sleeve comprises 8620 steel.

19. The cylinder heater of claim 15 wherein said predetermined rotational speeds are between about 600 rpm and about 1000 rpm.

20. The cylinder heater of claim 15 wherein said metallic powder layer comprises tungsten carbide.

* * * * *